US006907653B2

(12) United States Patent
Chupak

(10) Patent No.: US 6,907,653 B2
(45) Date of Patent: Jun. 21, 2005

(54) METHOD OF AFFIXING A THREADED SLEEVE TO THE NECK OF AN ALUMINUM CONTAINER

(75) Inventor: Thomas Chupak, West Middlesex, PA (US)

(73) Assignee: Exal Corporation, Youngstown, OH (US)

( * ) Notice: Subject to any disclaimer, the term of this patent is extended or adjusted under 35 U.S.C. 154(b) by 0 days.

(21) Appl. No.: 10/282,652

(22) Filed: Oct. 29, 2002

(65) Prior Publication Data

US 2003/0116521 A1 Jun. 26, 2003

Related U.S. Application Data

(62) Division of application No. 10/005,044, filed on Dec. 4, 2001, now abandoned.

(51) Int. Cl.[7] ..... B23P 11/00
(52) U.S. Cl. ..... 29/512; 72/379.4
(58) Field of Search ..... 29/512; 72/379.4, 72/378, 348, 349, 370, 356; 413/1, 2, 6, 23, 69

(56) References Cited

U.S. PATENT DOCUMENTS

| | | | | |
|---|---|---|---|---|
| 2,384,810 A | | 9/1945 | Calleson et al. | |
| 2,829,802 A | * | 4/1958 | Paull | 29/512 |
| 4,371,282 A | * | 2/1983 | Sturm | 29/523 |
| 5,293,765 A | | 3/1994 | Nussbaum-Pogacnik | |
| 5,356,030 A | | 10/1994 | Budenbender | |
| D384,888 S | | 10/1997 | Dickhoff | |
| 5,713,235 A | | 2/1998 | Dickhoff | |
| 5,718,352 A | | 2/1998 | Dickhoff et al. | |
| 5,778,723 A | | 7/1998 | Dickhoff | |
| 5,822,843 A | | 10/1998 | Dickhoff et al. | |
| 6,010,026 A | | 1/2000 | Dickhoff et al. | |
| 6,010,028 A | | 1/2000 | Jordan et al. | |
| 6,105,807 A | | 8/2000 | McCrossen | |
| 6,375,020 B1 | * | 4/2002 | Marquez | 215/232 |
| 6,543,636 B1 | * | 4/2003 | Flecheux et al. | 220/288 |
| 2001/0040167 A1 | | 11/2001 | Flecheux et al. | |

FOREIGN PATENT DOCUMENTS

| | | |
|---|---|---|
| CA | 715378 | 8/1965 |
| DE | 1129077 | 5/1962 |
| DE | 69 03 478 U | 5/1969 |
| EP | 29293 | 5/1981 |
| EP | 0 549 987 A | 7/1993 |
| EP | 1 069 049 A | 1/2001 |
| FR | 1258715 | 3/1961 |
| GB | 285 612 A | 2/1928 |
| JP | 61 088932 A | 5/1993 |
| JP | 11-139438 | 5/1999 |

* cited by examiner

*Primary Examiner*—David P. Bryant
(74) *Attorney, Agent, or Firm*—Thorp Reed & Armstrong, LLP

(57) ABSTRACT

An aluminum container is comprised of a base portion, a substantially vertical wall portion extending upwardly from the base portion, a transition portion extending from the wall portion, and a neck portion extending from the transition portion. The neck portion is tapered and has an upper end having a wall thickness that is preferably less than the thickness of the wall of the remainder of the neck portion. The upper end of the neck portion may also be chamfered. The aluminum container of the present invention may be combined with a threaded sleeve to form a receptacle. The sleeve has an outer surface and an inner surface. The outer surface has threads thereon and the inner surface has a taper complementary to the taper of the neck portion so as to form a friction fit with the neck portion. The sleeve may also have a notch formed in the periphery of its upper outside surface. When the upper chamfered end of the neck is curled, the neck portion extends over a top end portion of the sleeve and terminates in the notch in the sleeve. Methods of manufacturing such a container are also disclosed.

9 Claims, 10 Drawing Sheets

METHOD OF AFFIXING A THREADED SLEEVE TO THE NECK OF AN ALUMINUM CONTAINER

This Application is a divisional application of U.S. application Ser. No. 10/005,044 assigned a filing date of 04 Dec. 2001 now abandoned.

BACKGROUND OF THE INVENTION

1. Field of the Invention

The present invention is directed to aluminum receptacles and, more particularly, to aluminum receptacles having a threaded neck for receiving a cap.

2. Description of the Background

It is known in the art to form drawn, or drawn and ironed, cans from aluminum and steel for use in the packaging of beer, soft drinks, oil, and other liquids. Most metal cans for beer and beverages are adapted to be closed with relatively flat lids or ends which are secured on the cans by double seaming or a similar process. The lids may have tear strips formed in them and pull tabs attached to the tear strips to facilitate access to the tear strips to thereby provide an opening in the lid.

Not all aluminum containers have flat tops. It is known in the art to use a series of necking dies on an aluminum container to form a neck on one end of the container. Threads may then be formed in the neck portion of the container by positioning first and second thread rolling tools adjacent to inside and outside surfaces, respectively, of the neck and rotatably moving the tools against the surface. Threaded aluminum containers have typically been made from relatively thick metal, i.e., at least 0.020 inches thick. The material is typically pure aluminum (99.5–99.8% aluminum) which is relatively soft and permits the forming of threads in the neck.

The insides of aluminum containers are very often provided with a coating which prevents interaction between the raw aluminum and the contents of the container. The process of forming threads on the neck portion of the container may crack and/or dislodge portions of the coating thereby allowing the contents of the container to come into contact with raw aluminum. Furthermore, a coating which is cracked or otherwise damaged may work loose after the container is filled thereby contaminating the contents of the container.

An improvement over forming the threads directly in the aluminum container is to secure a sleeve of plastic or other material around the neck of the aluminum container. Examples of the use of such a sleeve can be found in U.S. Pat. No. 5,713,235 entitled "Method and Apparatus for Die Necking a Metal Container," U.S. Pat. No. 6,010,026 entitled "Assembly of Aluminum Can and Threaded Sleeve," U.S. Pat. No. 5,718,352 entitled "Threaded Aluminum Cans and Methods of Manufacture," U.S. Pat. No. 5,778,723 entitled "Method and Apparatus for Necking a Metal Container and Resultant Container," U.S. Pat. No. 6,010,028 entitled "Lightweight Reclosable Can with Attached Threaded Pour Spout and Methods of Manufacture," and U.S. Pat. No. 5,822,843 entitled "Method of Making Bottle-Shaped Metal Cans." Very often, to prevent rotation of the sleeve on the container, small dents, ribs, slots or the like are provided on the container and/or the sleeve. The sleeve can also be adhesively bonded to the container to prevent relative rotation. However, forming of dents, ribs, slots, or the like in the container may damage the protective coating on the inside of the container. Therefore, the need exits for a method for securing a threaded sleeve to the neck of an aluminum container and the improved container resulting therefrom.

SUMMARY OF THE INVENTION

The present invention is directed to an aluminum container comprising a base portion, a substantially vertical wall portion extending upwardly from the base portion, a transition portion extending from the wall portion, and a neck portion extending from the transition portion. The neck portion is tapered and has an upper end having a wall thickness that is preferably less than the thickness of the wall of the remainder of the neck portion. The upper end of the neck portion may also be chamfered.

The aluminum container of the present invention may be combined with a threaded sleeve to form a receptacle. The sleeve has an outer surface and an inner surface. The outer surface has threads thereon and the inner surface has a taper complementary to the taper of the neck portion so as to form a friction fit with the neck portion. The sleeve may also have a notch formed in the periphery of its upper outside surface. When the upper chamfered end of the neck is curled, the neck portion extends over a top end portion of the sleeve and terminates in the notch in the sleeve.

The present invention is also directed to a method of affixing a sleeve to the neck of an aluminum bottle of the type having a tapered neck and wherein the sleeve has a complementary taper. The method is comprised of positioning the sleeve onto the neck such that a portion of the neck extends beyond the sleeve, and curling the portion of the neck extending beyond the sleeve so that the curl covers at least a portion of the upper end of the sleeve. The curling step causes the sleeve to seat on the neck so as to form a friction fit therewith.

By providing the neck portion of the container with a taper, and providing the threaded sleeve with a complementary taper, a friction fit can be obtained without requiring any dimples, dents, or similar structure in either the neck portion or the threaded sleeve. Because of the taper, the threaded sleeve can be easily inserted onto the neck portion of the container. Thereafter, the curling process (which curls the end of the neck portion extending beyond the sleeve) pushes the threaded sleeve further down onto the neck portion of the container thereby causing an extremely tight friction fit. By controlling the amount of the neck portion which extends beyond the threaded sleeve, and therefore the amount of material available for curling, the threaded sleeve can be precisely positioned on the neck portion of the container. Additionally, by providing a notch in the upper outside peripheral surface of the threaded sleeve, the curled edge of the neck portion may terminate in the notch thereby covering the entire top edge of the threaded sleeve as well as providing a smooth profile for the finished receptacle. There is no exposed aluminum, and no possibility of damaging the protective coating on the inside of the container. Those, and other advantages and benefits, will become apparent from the detailed description of the preferred embodiments hereinbelow.

BRIEF DESCRIPTION OF THE DRAWINGS

For the present invention to be easily understood and readily practiced, the present invention will now be described, for purposes of illustration and not limitation, in conjunction with the following figures, wherein.

DETAILED DESCRIPTION OF THE PREFERRED EMBODIMENTS

Figure 1:
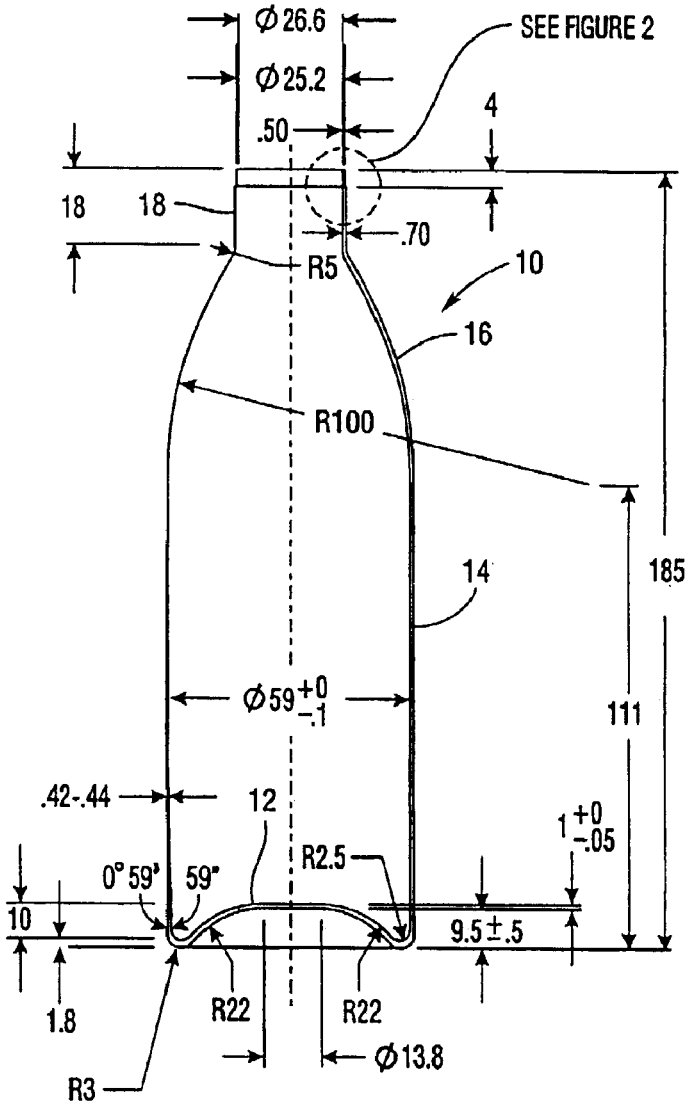
FIG. 1 illustrates a container constructed according to the present invention.

FIG. 1 illustrates a container 10 constructed according to the present invention. The exemplary dimensions illustrated in FIG. 1 are for purposes of illustration and not limitation. All dimension are in millimeters.

The container 10 is comprised of a base portion 12 from which extends a substantially vertical wall portion 14. A transition portion 16 extends from the wall portion 14 and a neck portion 18 extends from the transition portion 16. It is anticipated that the container 10 may be fabricated using a well known impact extrusion process. In the impact extrusion process, a slug of substantially pure aluminum (meaning aluminum having a purity of approximately 99.5–99.8%) is impact extruded to form a container of the desired diameter and having walls of a given height. After impact extrusion, the wall portion 16 may be lengthened using one or more dies. Thereafter, the container is trimmed to remove the uneven edges.

After trimming, the interior of the container may be coated with a protective coating of lacquer which is then cured in an oven. Thereafter, graphics may be applied to the outside of the container 10.

Figure 3:
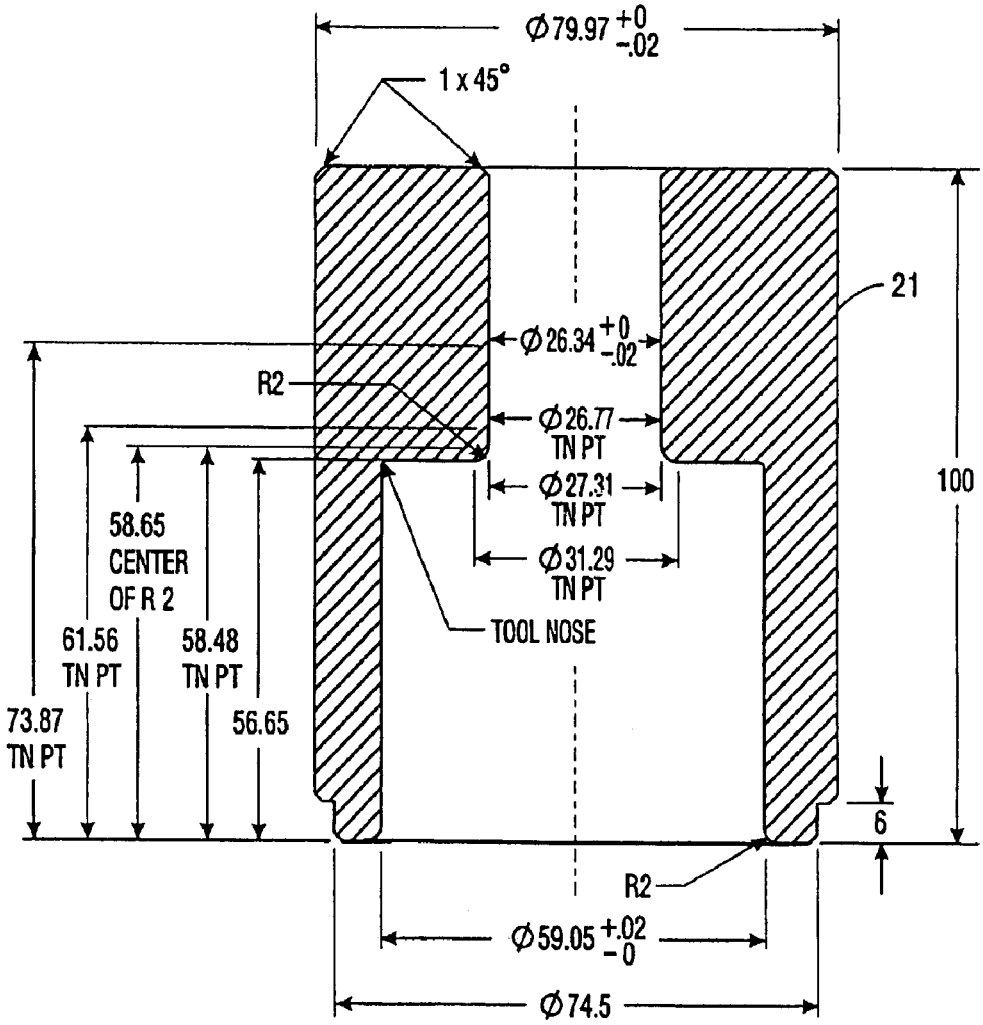
FIG. 3 illustrates an exemplary necking die.

The typical impact extrusion process used to produce, for example, aerosol containers, is modified after the neck portion 18 has been formed through the application of a series of necking dies according to known processes. After the neck portion 18 has been formed, the final necking die or dies imparts a slight taper to the neck 18. An exemplary necking die 21 is illustrated in FIG. 3. As can be seen from the exemplary necking die in FIG. 3, upon insertion of the container 10, the neck portion 18 is tapered such that the neck portion is approximately 26.6 millimeters at its top and 25.2 millimeters at its bottom. Although the taper in the preferred embodiment is approximately 1°, it is anticipated that tapers of other dimensions may be used. The dimensions shown in FIG. 3 are exemplary only.

Figure 2:
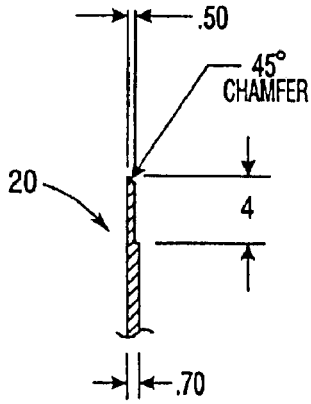
FIG. 2 illustrates the detail of the upper end of the neck portion of the container.

After the neck portion 18 has been tapered, a portion of the material at an upper end 20 thereof is removed so that the upper end 20 of the neck portion 18 has a wall thickness that is less than the thickness of the wall of the remainder of the neck portion 18 as illustrated in FIG. 2. In the embodiment shown in FIG. 2, 0.20 mm of material has been removed from the topmost 4 millimeters of the upper end 20 of the neck portion 18. Additionally, the end of the neck portion 18 has been chamfered at 45°. Although the detail shown in FIG. 2 is not necessary to obtain a friction fit between a threaded sleeve 22 illustrated in FIGS. 4–7 and the neck portion 18 of the present invention, removal of the material and chamfering of the edge provide advantages which will be described hereinbelow.

Figure 4:
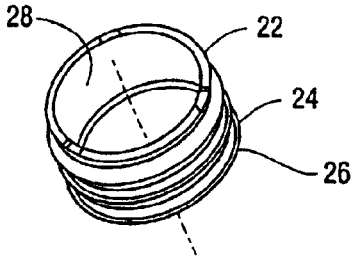
FIG. 4 is a perspective view of the threaded sleeve.
Figure 5:
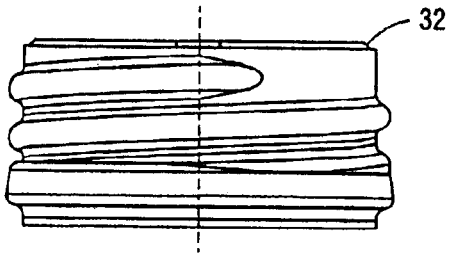
FIG. 5 is a side view of the threaded sleeve.
Figure 6:
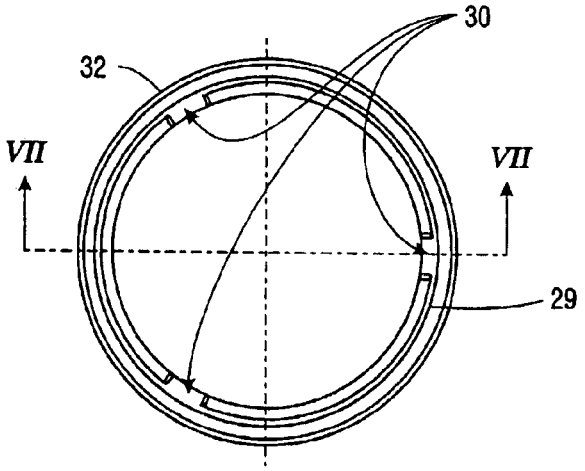
FIG. 6 is a top view of the threaded sleeve.
Figure 7:
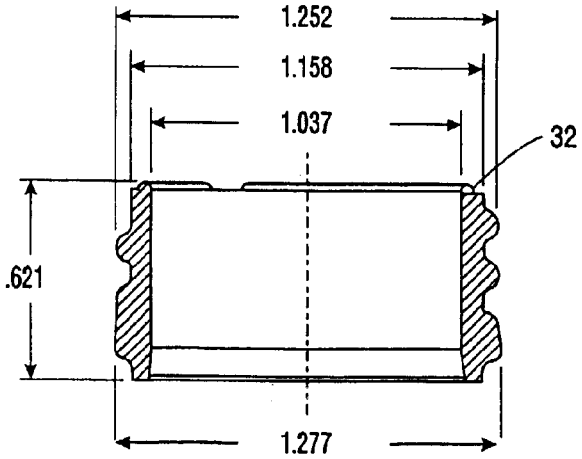
FIG. 7 is a cross-sectional view of the threaded sleeve taken along the lines VII—VII in FIG. 6.

Turning now to FIGS. 4–7, the threaded sleeve 22 is illustrated. As seen in FIG. 4, the threaded sleeve 22 has an outer surface 24 carrying threads 26 and an inner surface 28. The inner surface 28 is provided with a taper complementary to the taper on the neck portion 18 of the container 10. As seen best in FIG. 6, a top edge 29 of the threaded sleeve 22 may have notches 30 which are a remnant of the process used to manufacture the sleeve 22. The exemplary dimension illustrated in FIG. 7 are for purposes of illustration only, and not limitation. The threaded sleeve 22 is preferably comprised of plastic but may be comprised of a number of other materials such as aluminum or other metals.

As can be seen in FIGS. 5, 6, and 7, a notch 32 is formed in the periphery of the upper outer surface 24 and at the top edge 29 of the sleeve 22. The purpose of the notch 32 is described hereinbelow.

Figure 8:
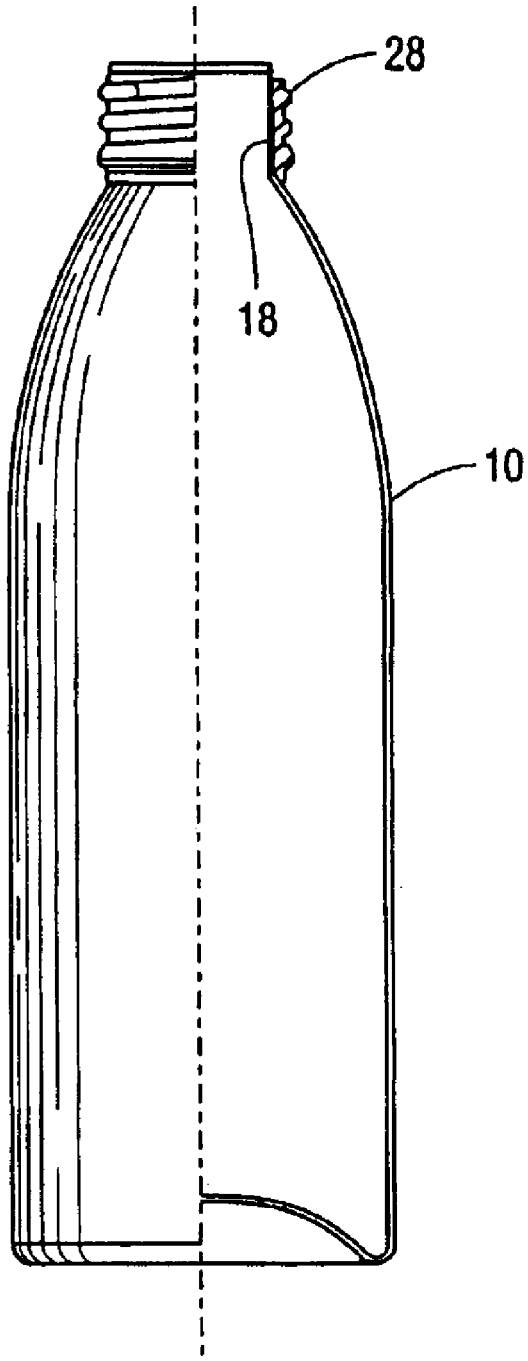
FIG. 8 illustrates the combination of a container as shown in FIG. 1 carrying a sleeve as shown in FIG. 4.

Turning now to FIG. 8, a container of the type illustrated in FIG. 1 is illustrated carrying a threaded sleeve 22 of the type illustrated in FIG. 4 on the neck portion 18 of the container 10. Approximately 2–3 millimeters of the upper end 20 of the neck portion 18 extends beyond the threaded sleeve 22. The final seating of the sleeve 22 on the neck portion 18 can be controlled by the height by which the upper end 20 of the neck portion 18 extends beyond the threaded sleeve 22 as will be described.

Figure 9:
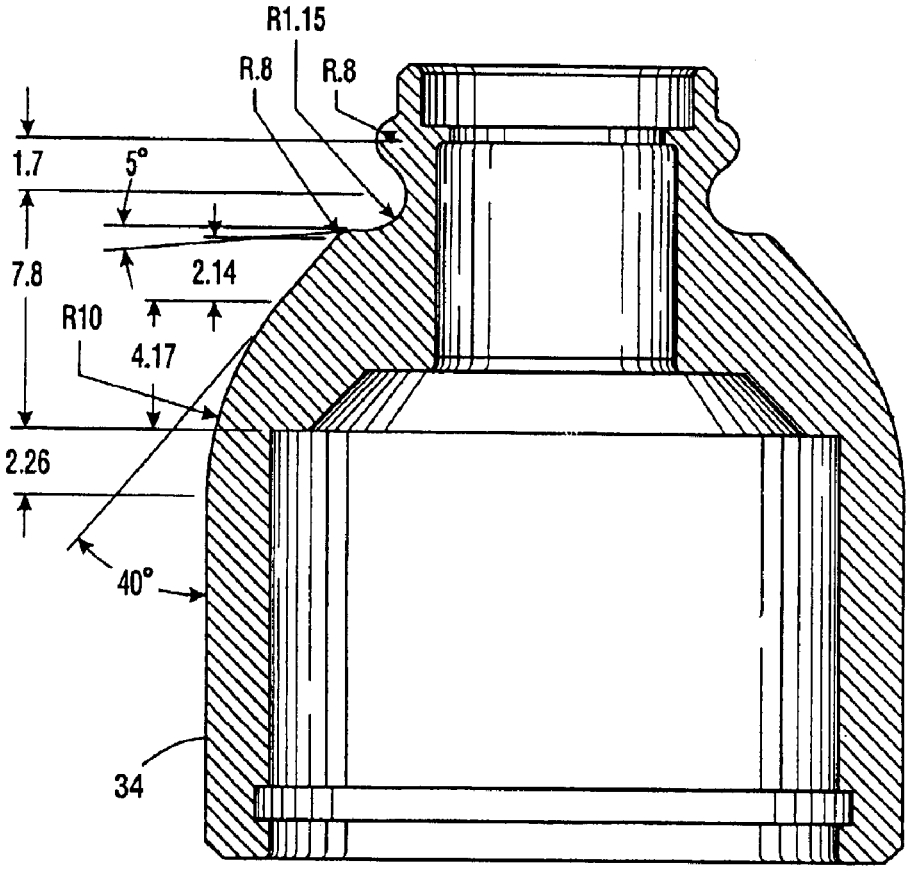
FIG. 9 illustrates an exemplary curling die.
Figure 10:
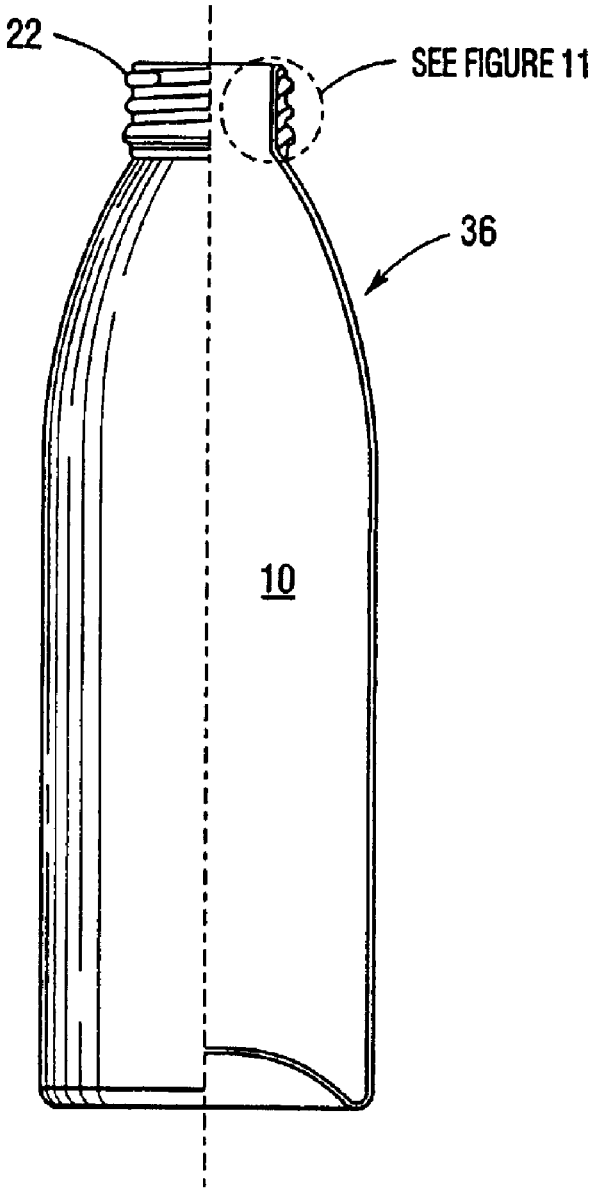
FIG. 10 illustrates a receptacle formed from the container and sleeve.
Figure 11:
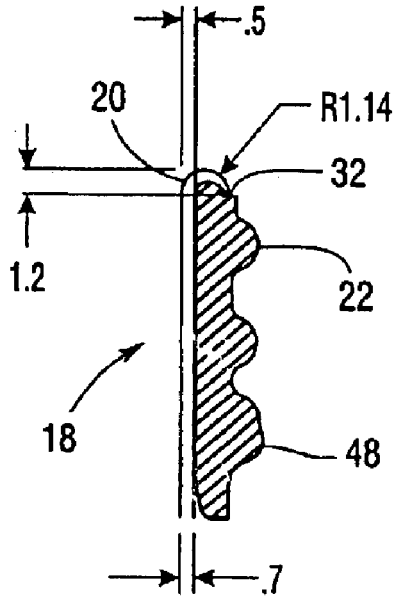
FIG. 11 illustrates the detail of the neck portion carrying the sleeve.
Figure 12:
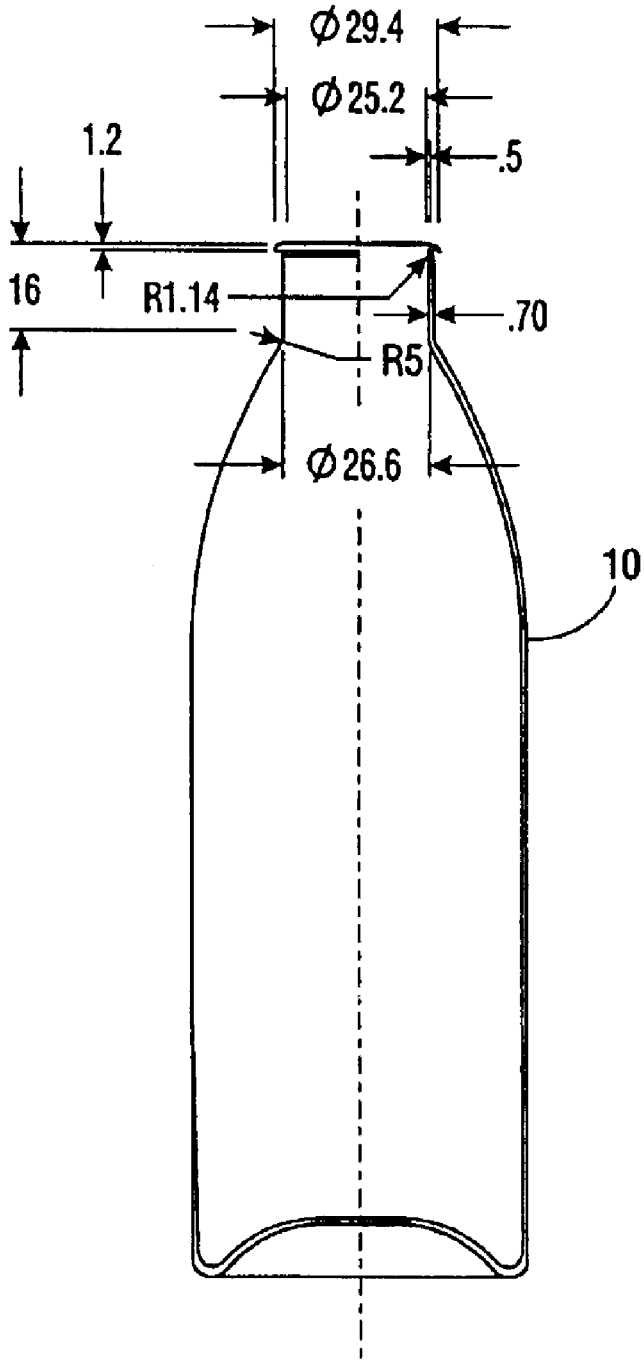
FIG. 12 illustrates a container not carrying a threaded sleeve; the container end has been curled to further illustrate the curl.

The container illustrated in FIG. 8 is input to a plurality of curling dies 34, one of which is illustrated in FIG. 9. The plurality of curling dies 34 is positioned around a centering mandrill, not shown. The upper end 20 of the container 10 is guided into the plurality of curling dies 34 through the use of the centering mandrill. Curling dies 34 cause the material of the upper end 20 of the neck portion 18 extending beyond the threaded sleeve 22 to be curled as seen in FIGS. 10, 11, and 12. The dimensions illustrated in FIG. 9 are exemplary only and are not limitations on the present invention.

Turning now to FIGS. 10, 11, and 12, FIG. 10 illustrates a completed receptacle 36. As is seen, the completed receptacle 36 is comprised of the container 10 and the threaded sleeve 22 fastened thereto. In the present invention, the fastening mechanism is primarily by means of a friction fit.

As seen in greater detail in FIG. 11, the upper end 20 of the neck portion 18 is curled so that it completely covers the upper edge 29 of the sleeve 22. Additionally, the curl terminates in the notch 32 formed in threaded sleeve 22. As can be seen in FIG. 11, by virtue of the reduced thickness of the upper end 20 and the chamfer, the curl terminates in notch 32 in a manner to provide a substantially unbroken profile for the top of the receptacle 36. In addition, the curled portion is covered with lacquer so that there is no exposed aluminum. Finally, the curl completely covers the top edge 29, and hence the notches 30, in the top edge 29 of the threaded sleeve 22. As with the other figures, the dimensions shown in FIG. 11 are exemplary only and do not limit the scope of the present invention.

In FIG. 12, a container 10 is illustrated which has been curled without the threaded sleeve. Thus, FIG. 12 provides an additional illustration of the curl formed on the upper end 20 of the neck portion 18. The dimensions shown in FIG. 12 are exemplary only and are not intended to limit the scope of the present invention.

Figure 13:
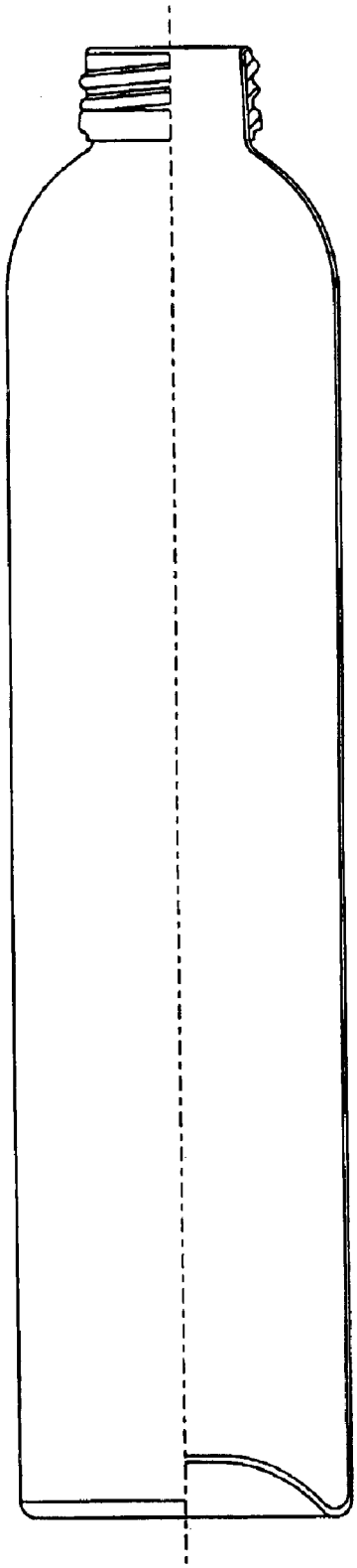
FIGS. 13–16 illustrate other shapes for the transition portion of the container/finished receptacle.
Figure 14:
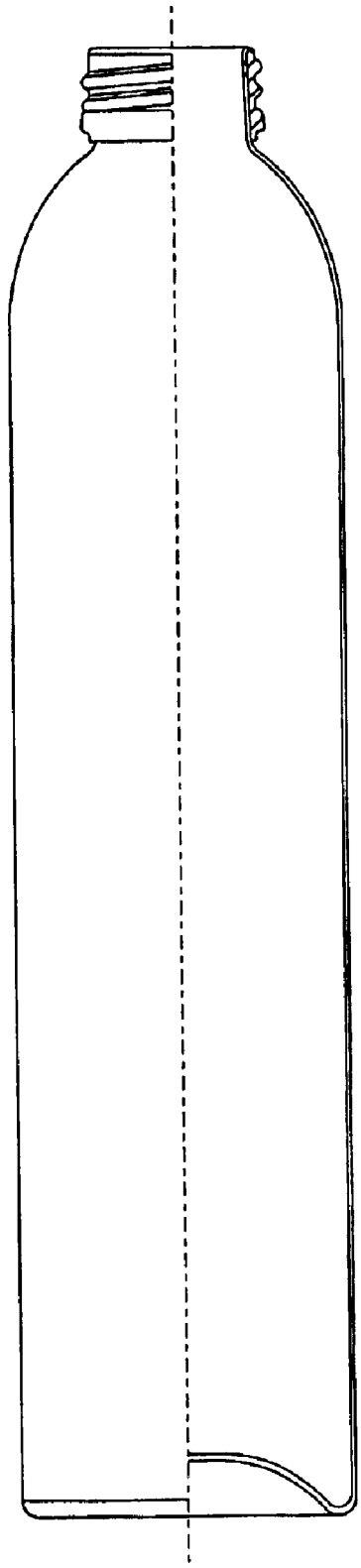
Figure 15:
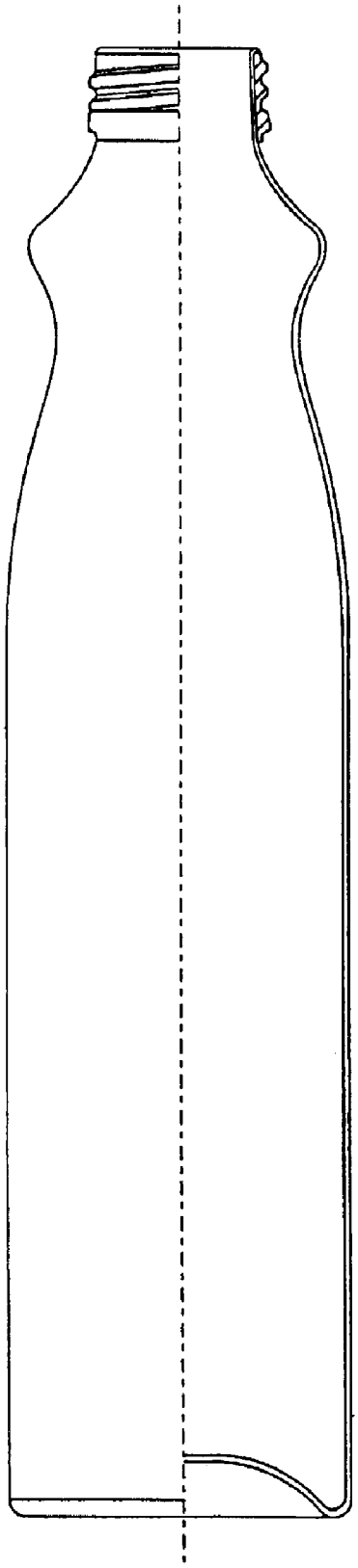
Figure 16:
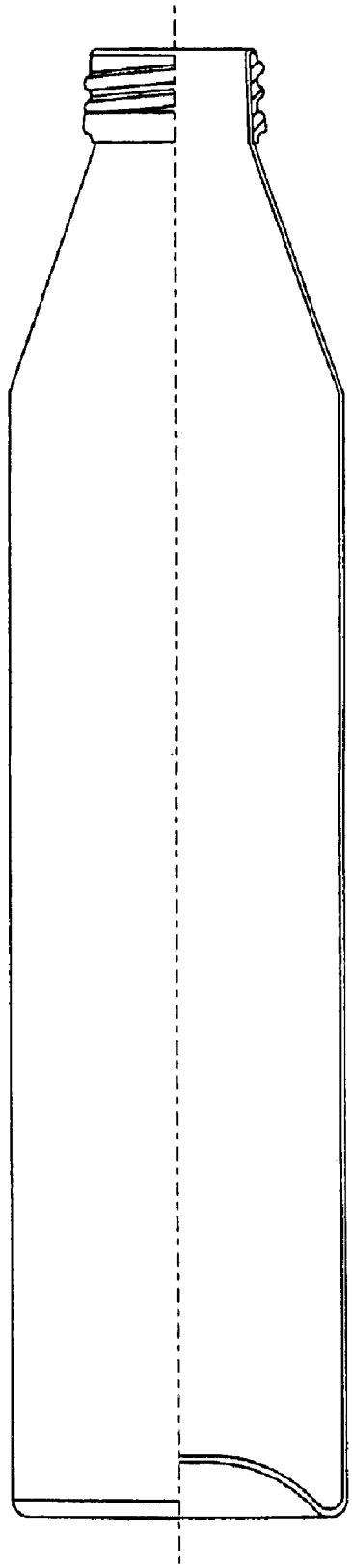

It is anticipated that the container and resulting receptacle of the present invention may be formed in a variety of shapes and sizes. It is anticipated that the container and resulting receptacle may have a diameter of, for example, 35 mm–66 mm and a height of, for example, 70 mm–260 mm. The transition portion 16 illustrated in FIG. 1 is referred to as a tapered shoulder. Other types of transition portions 16 may include a round shoulder as shown in FIG. 13, an oval shoulder as shown in FIG. 14, an ergonomic shoulder as shown in FIG. 15, and a flat shoulder as shown in FIG. 16.

Figure 17:
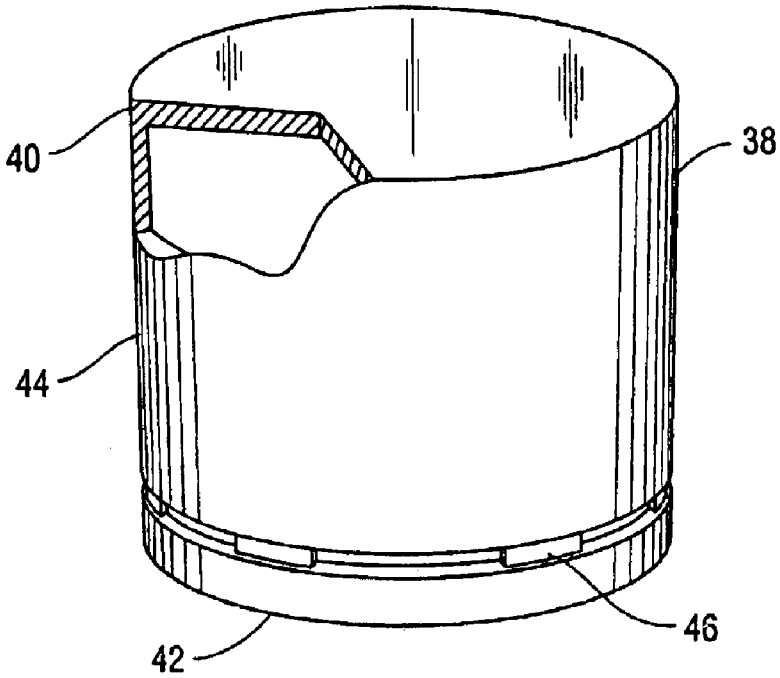
FIG. 17 illustrates a cap.
Figure 1:
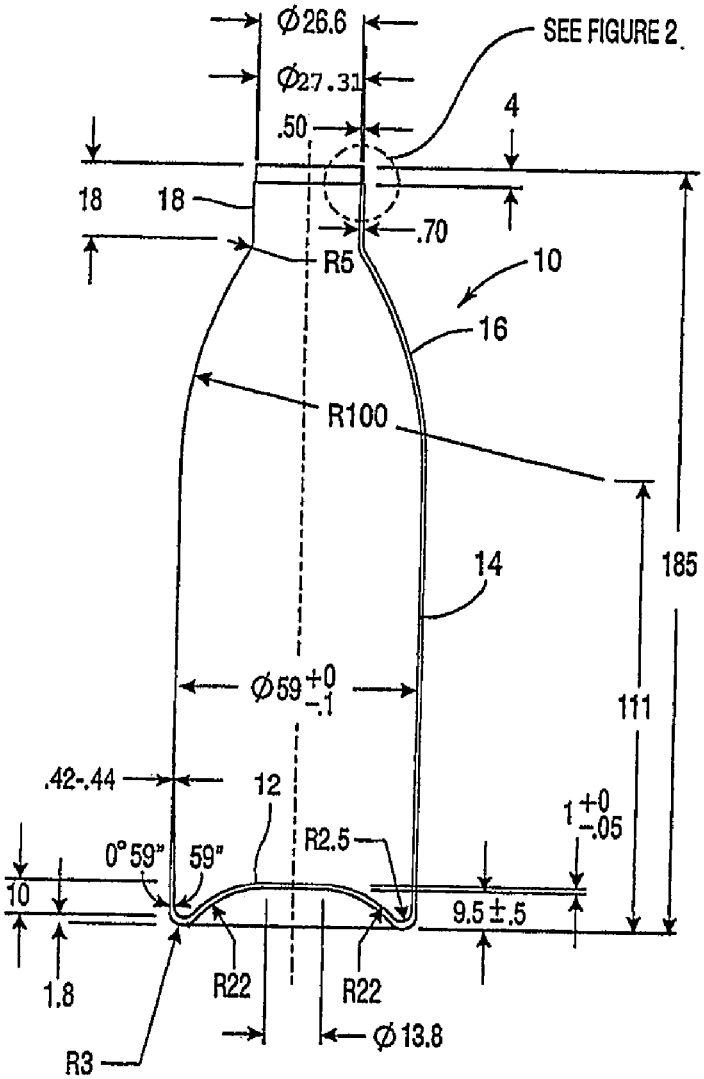
Figure 2:
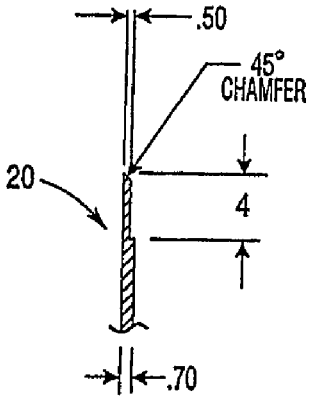
Figure 1:
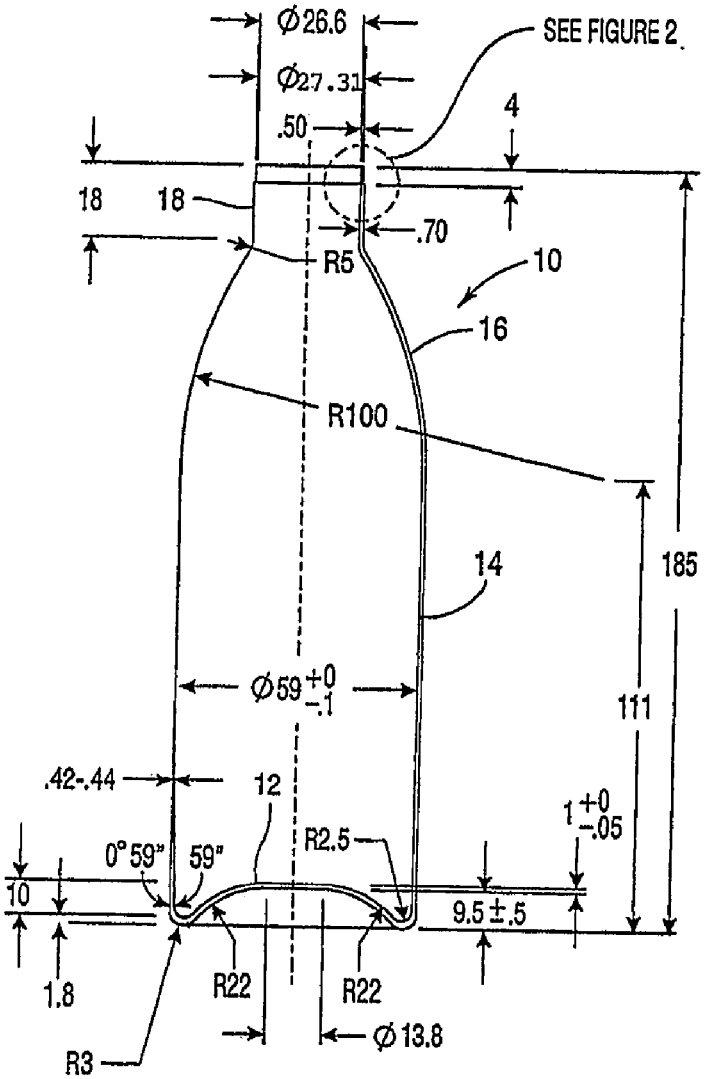
Figure 2:
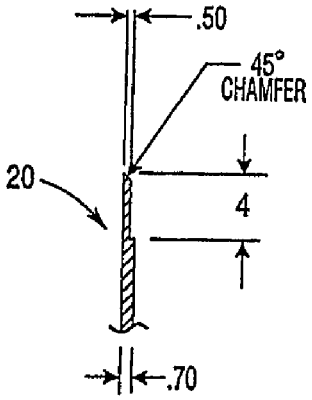

FIG. 17 illustrates a cap 38 which may be used to seal the receptacle 36 of the present invention. The cap 38 is preferably formed of aluminum. The cap 38 has at the top thereof a material, such as PVC, which is intended to act as a liner and create a seal. The cap 38 is positioned over the threaded sleeve 22 of the container 36. Thereafter, pressure is applied, for example, a pressure of 35 inch pounds, in a downward manner to affect the seal. While the downward pressure is applied, thread rollers apply side pressure of, for example, 38 inch pounds, to cause the cap 38 to deform to thereby produce threads complementary to the threads carried by the threaded sleeve 22.

A tamper seal 42 is carried at a bottom edge 44 of the cap 38 by a plurality of breakaway members 46. As is known in the art, as the cap 38 is applied to the receptacle 36, the tamper seal 42 is bent inwardly. The inward bending of the tamper seal causes the tamper seal to be tucked under, for example, a bottom protrusion 48 of the threaded sleeve 22 best seen in FIG. 11. With the tamper seal 42 thus positioned, removal of the cap 38 will cause the break away members 46 to break away from the tamper seal 42 thereby leaving the tamper seal 42 on the neck of the receptacle while the cap 38 is removed. Cap 38, being threaded, may then be replaced on receptacle 36 to reseal it. Other types of caps and tamper seals may be provided. For example, ratchet teeth (not shown) may be formed on the bottom of threaded sleeve 22 which meet with teeth held in the tamper seal, which is connected to a cap through break away members. Rotation of the cap in a clockwise direction allows the cap to be seated while rotation in a counter-clockwise direction causes the tamper seal to break away.

While the present invention has been described in conjunction with preferred embodiments thereof, those of ordinary skill in the art will recognize that many modifications and variations are possible. Such modifications and variations fall within the scope of the present invention which is limited only by the following claims.

What is claimed is:

1. A method of affixing a sleeve to the neck of an aluminum container of the type having a tapered neck and wherein said sleeve has a complementary taper, said method comprising:

positioning said sleeve onto said neck such that a portion of the neck extends beyond said sleeve;

curling the portion of the neck extending beyond the sleeve so that the curl covers at least a portion of the upper end of said sleeve, said curling step causing said sleeve to seat on the neck so as to form a friction fit therewith, wherein said friction fit is formed without expansion or deformation of said neck and wherein said friction fit prevents rotation of said sleeve relative to said neck.

2. The method of claim 1 wherein said curling step causes said sleeve to further seat on said neck.

3. The method of claim 1 wherein the portion of the neck extending beyond the sleeve is approximately 2–3 mm in length.

4. The method of claim 1 additionally comprising the step of decreasing the thickness of at least a portion of that portion of the neck extending beyond said sleeve.

5. The method of claim 4 additionally comprising the step of chamfering the upper edge of the neck.

6. A method of affixing a sleeve to the neck of an aluminum container of the type having a tapered neck and wherein said sleeve has a complementary taper and a notch formed in the periphery of its upper outside surface, said method comprising:

positioning said sleeve onto said neck such that a portion of the neck extends beyond said sleeve;

curling the portion of the neck extending beyond the sleeve so that the curl covers the top edge of said sleeve and terminates in said notch in said sleeve, said curling step causing said sleeve to seat on the neck so as to form a friction fit therewith, wherein said friction fit is formed without expansion or deformation of said neck and wherein said friction fit prevents rotation of said sleeve relative to said neck.

7. The method of claim 6 wherein the portion of the neck extending beyond the sleeve is approximately 2–3 mm in length.

8. The method of claim 6 additionally comprising the step of decreasing the thickness of at least a portion of that portion of the neck extending beyond said sleeve.

9. The method of claim 8 additionally comprising the step of chamfering the upper edge of the neck.

* * * * *

UNITED STATES PATENT AND TRADEMARK OFFICE

CERTIFICATE OF CORRECTION

PATENT NO. : 6,907,653 B2
APPLICATION NO. : 10/282652
DATED : June 21, 2005
INVENTOR(S) : Thomas Chupak It is certified that error appears in the above-identified patent and that said Letters Patent is hereby corrected as shown below:

Column 1, line 67, delete “exits” and insert therefore -- exists --.

In the Claims:

Claim 1, Column 6, line 6, delete “such that” and insert therefore -- wherein --.
Claim 6, Column 6, line 31, delete “such that” and insert therefore -- wherein --.

Signed and Sealed this

Twenty-first Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 6,907,653 B2
APPLICATION NO. : 10/282652
DATED : June 21, 2005
INVENTOR(S) : Thomas Chupak It is certified that error appears in the above-identified patent and that said Letters Patent is hereby corrected as shown below:

Column 3, line 56, delete "top and 25.2" and insert therefore -- upper end 20 and 27.31 --.
Column 3, line 62, delete "an" and insert therefore -- the --.

In the Drawings:

DELETE DRAWING SHEET 1, CONTAINING FIGS 1&2, AND REPLACE WITH DRAWING SHEET, CONTAINING FIGS 1&2. (ATTACHED)

Signed and Sealed this

Sixteenth Day of October, 2007

JON W. DUDAS
*Director of the United States Patent and Trademark Office*

UNITED STATES PATENT AND TRADEMARK OFFICE

CERTIFICATE OF CORRECTION

PATENT NO. : 6,907,653 B2
APPLICATION NO. : 10/282652
DATED : June 21, 2005
INVENTOR(S) : Thomas Chupak It is certified that error appears in the above-identified patent and that said Letters Patent is hereby corrected as shown below:

Column 3, line 56, delete "top and 25.2" and insert therefore -- upper end 20 and 27.31 --.
Column 3, line 62, delete "an" and insert therefore -- the --.

In the Drawings:

DELETE DRAWING SHEET 1, CONTAINING FIGS 1&2, AND REPLACE WITH DRAWING SHEET, CONTAINING FIGS 1&2. (ATTACHED)

Delete the title page and substitute therefor the attached title page.

This certificate supersedes Certificate of Correction issued October 16, 2007.

Signed and Sealed this

Thirteenth Day of November, 2007

JON W. DUDAS
*Director of the United States Patent and Trademark Office*

(12) United States Patent
Chupak

(10) Patent No.: US 6,907,653 B2
(45) Date of Patent: Jun. 21, 2005

(54) METHOD OF AFFIXING A THREADED SLEEVE TO THE NECK OF AN ALUMINUM CONTAINER

(75) Inventor: Thomas Chupak, West Middlesex, PA (US)

(73) Assignee: Exal Corporation, Youngstown, OH (US)

( * ) Notice: Subject to any disclaimer, the term of this patent is extended or adjusted under 35 U.S.C. 154(b) by 0 days.

(21) Appl. No.: 10/282,652

(22) Filed: Oct. 29, 2002

(65) Prior Publication Data

US 2003/0116521 A1 Jun. 26, 2003

Related U.S. Application Data

(62) Division of application No. 10/005,044, filed on Dec. 4, 2001, now abandoned.

(51) Int. Cl.[7] ..... B23P 11/00
(52) U.S. Cl. ..... 29/512; 72/379.4
(58) Field of Search ..... 29/512; 72/379.4, 72/378, 348, 349, 370, 356; 413/1, 2, 6, 23, 69

(56) References Cited

U.S. PATENT DOCUMENTS

| | | | | |
|---|---|---|---|---|
| 2,384,810 A | | 9/1945 | Calleson et al. | |
| 2,829,802 A | * | 4/1958 | Fault | 29/512 |
| 4,371,282 A | * | 2/1983 | Sturm | 29/523 |
| 5,293,765 A | | 3/1994 | Nussbaum-Pogscnik | |
| 5,358,030 A | | 10/1994 | Budenhender | |
| D384,898 S | | 10/1997 | Dickhoff | |
| 5,713,235 A | | 2/1998 | Dickhoff | |
| 5,718,352 A | | 2/1998 | Dickhoff et al. | |
| 5,778,723 A | | 7/1998 | Dickhoff | |
| 5,822,843 A | | 10/1998 | Dickhoff et al. | |
| 6,010,026 A | | 1/2000 | Dickhoff et al. | |
| 6,010,028 A | | 1/2000 | Jordan et al. | |
| 6,105,807 A | | 8/2000 | McCrossen | |
| 6,375,020 B1 | * | 4/2002 | Marquez | 215/232 |
| 6,543,656 B1 | * | 4/2003 | Flecheux et al. | 220/288 |
| 2001/0040167 A1 | | 11/2001 | Flecheux et al. | |

FOREIGN PATENT DOCUMENTS

| | | |
|---|---|---|
| CA | 715378 | 8/1965 |
| DE | 1129077 | 5/1962 |
| DE | 69 03 478 U | 5/1969 |
| EP | 29293 | 5/1981 |
| EP | 0 549 987 A | 7/1993 |
| EP | 1 069 049 A | 1/2001 |
| FR | 1258715 | 3/1961 |
| GB | 285 612 A | 2/1928 |
| JP | 61 088932 A | 5/1993 |
| JP | 11-139438 | 5/1999 |

* cited by examiner

*Primary Examiner*—David P. Bryant
(74) *Attorney, Agent, or Firm*—Thorp Reed & Armstrong, LLP

(57) ABSTRACT

An aluminum container is comprised of a base portion, a substantially vertical wall portion extending upwardly from the base portion, a transition portion extending from the wall portion, and a neck portion extending from the transition portion. The neck portion is tapered and has an upper end having a wall thickness that is preferably less than the thickness of the wall of the remainder of the neck portion. The upper end of the neck portion may also be chamfered. The aluminum container of the present invention may be combined with a threaded sleeve to form a receptacle. The sleeve has an outer surface and an inner surface. The outer surface has threads thereon and the inner surface has a taper complementary to the taper of the neck portion so as to form a friction fit with the neck portion. The sleeve may also have a notch formed in the periphery of its upper outside surface. When the upper chamfered end of the neck is curled, the neck portion extends over a top end portion of the sleeve and terminates in the notch in the sleeve. Methods of manufacturing such a container are also disclosed.

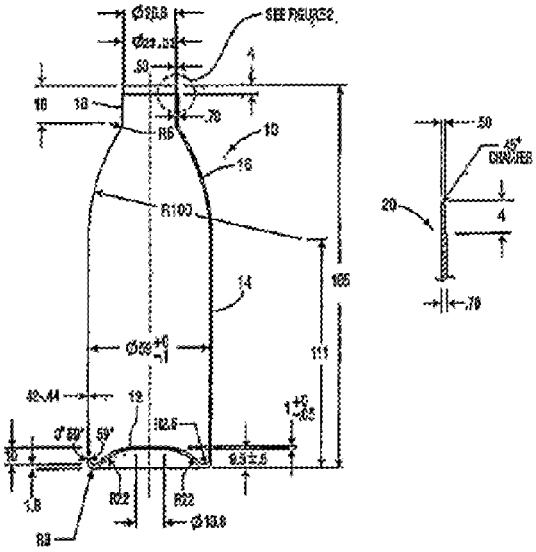

9 Claims, 10 Drawing Sheets